US010046947B2

(12) United States Patent
Haipus

(10) Patent No.: US 10,046,947 B2
(45) Date of Patent: Aug. 14, 2018

(54) ELEVATOR CONTROLLER CONFIGURED TO CONTROL AN ELEVATOR BASED ON A DETERMINATION OF WHICH OF A PLURALITY OF ELEVATOR CARS IS ASSOCIATED WITH A PASSENGER HAVING REGISTERED A DESTINATION CALL, A SYSTEM AND A METHOD OF OPERATING SAME

(71) Applicant: Ilpo Haipus, Nummela (FI)

(72) Inventor: Ilpo Haipus, Nummela (FI)

(73) Assignee: Kone Corporation, Helsinki (FI)

( * ) Notice: Subject to any disclaimer, the term of this patent is extended or adjusted under 35 U.S.C. 154(b) by 364 days.

(21) Appl. No.: 14/879,666

(22) Filed: Oct. 9, 2015

(65) Prior Publication Data

US 2016/0031676 A1 Feb. 4, 2016

Related U.S. Application Data

(63) Continuation of application No. PCT/FI2014/050361, filed on May 14, 2014.

(30) Foreign Application Priority Data

May 20, 2013 (FI) ..... 20135538

(51) Int. Cl.
*B66B 1/18* (2006.01)
*B66B 1/46* (2006.01)
(Continued)

(52) U.S. Cl.
CPC ..... *B66B 1/468* (2013.01); *B66B 1/3415* (2013.01); *B66B 5/0012* (2013.01);
(Continued)

(58) Field of Classification Search
CPC ..... B66B 1/468; B66B 1/3415; B66B 5/0012; B66B 2201/4615; B66B 2201/4653; B66B 2201/4669
(Continued)

(56) References Cited

U.S. PATENT DOCUMENTS 4,452,341 A * 6/1984 Tanahashi ..... B66B 1/306 187/291
5,258,587 A * 11/1993 Kezer ..... B66B 1/2408 187/388
(Continued)

FOREIGN PATENT DOCUMENTS

CN 202098937 U 1/2012
CN 202208580 U 5/2012
(Continued)

OTHER PUBLICATIONS

International Search Report PCT/ISA/210 for International Application No. PCT/FI2014/050361 dated Sep. 11, 2014.
(Continued)

*Primary Examiner* — Anthony Salata
(74) *Attorney, Agent, or Firm* — Harness, Dickey & Pierce, P.L.C.

(57) ABSTRACT

An elevator controller may include a memory configured to store acceleration data therein; and a processor configured to, register a passenger-specific destination call, the passenger-specific destination call including destination information indicating a destination floor of a passenger, receive passenger acceleration data indicating a vertical acceleration of the passenger in one of a plurality of elevator cars, compare elevator acceleration data of the plurality of elevator cars departing a floor with the passenger acceleration data, determine whether a correlation exists between the passenger acceleration data and the elevator acceleration data of a detected one of the plurality of elevator cars, and
(Continued)

Figure 1:
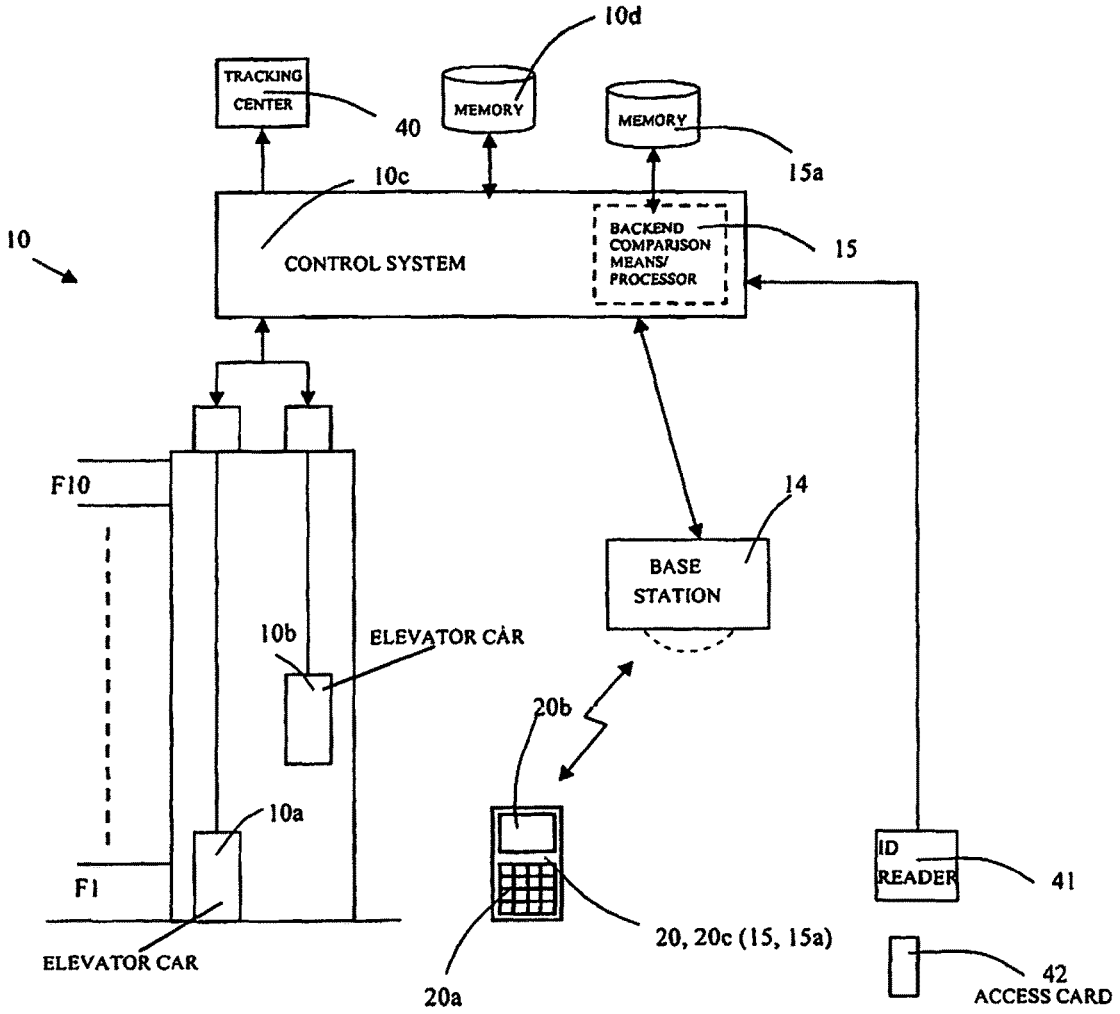

guide the detected one of the plurality of elevator cars that has left a floor to the destination floor according to the passenger-specific destination call, if the processor determines that the correlation exists.

17 Claims, 3 Drawing Sheets

(51) Int. Cl.
*B66B 5/00* (2006.01)
*B66B 1/34* (2006.01)

(52) U.S. Cl.
CPC ..... *B66B 2201/4615* (2013.01); *B66B 2201/4653* (2013.01); *B66B 2201/4669* (2013.01)

(58) Field of Classification Search
USPC ..... 187/247, 380–388, 391, 392, 396
See application file for complete search history.

(56) References Cited

U.S. PATENT DOCUMENTS 5,435,416 A * 7/1995 Siikonen ..... B66B 1/3484 187/392
5,485,347 A * 1/1996 Miura ..... G06M 1/101 104/28
5,949,037 A 9/1999 Oya
6,109,396 A 8/2000 Sirag et al.
7,190,256 B2 * 3/2007 Pieper ..... B66B 1/468 340/5.2
8,061,485 B2 * 11/2011 Finschi ..... B66B 1/468 187/384
8,196,711 B2 * 6/2012 Tokura ..... B66B 1/2458 187/382
8,584,811 B2 * 11/2013 Kuoppala ..... B66B 1/468 187/316
8,813,917 B2 * 8/2014 Salmikuukka ..... B66B 1/468 187/247
8,857,569 B2 * 10/2014 Friedli ..... B66B 5/0012 187/384
8,910,752 B2 * 12/2014 Furutani ..... B66B 1/468 187/384
9,238,568 B2 * 1/2016 Nonami ..... B66B 1/468
9,323,232 B2 * 4/2016 Blom ..... G05B 13/00
2008/0011557 A1 1/2008 Hakala et al.
2009/0218177 A1 9/2009 Tyni et al.
2011/0127117 A1 6/2011 Amano

FOREIGN PATENT DOCUMENTS

JP 2007001758 A 1/2007
JP 2011057322 A 3/2011
WO WO-2009007492 A1 1/2009

OTHER PUBLICATIONS

Written Opinion of the International Searching Authority PCT/ISA/237 for International Application No. PCT/FI2014/050361 dated Sep. 11, 2014.
Finish Search Report for Application No. 20135538 dated Oct. 2, 2013.

* cited by examiner

ELEVATOR CONTROLLER CONFIGURED TO CONTROL AN ELEVATOR BASED ON A DETERMINATION OF WHICH OF A PLURALITY OF ELEVATOR CARS IS ASSOCIATED WITH A PASSENGER HAVING REGISTERED A DESTINATION CALL, A SYSTEM AND A METHOD OF OPERATING SAME

This application is a continuation of PCT International Application No. PCT/FI2014/050361 which has an International filing date of May 14, 2014, and which claims priority to Finnish patent application number 20135538 filed May 20, 2013, the entire contents of both of which are incorporated herein by reference.

FIELD OF THE INVENTION

The invention relates to elevator systems. More particularly the invention relates to a method and to an elevator system for serving passenger-specific destination calls in an elevator system.

BACKGROUND OF THE INVENTION

With regard to elevator systems, call-giving solutions are known in which a passenger can give a destination call to the elevator system by means of terminal device, such as e.g. a mobile phone, in his/her possession. In connection with the elevator system is a base, which receives calls and/or identification data (an ID code) sent from the terminal device and transmits them to the control system of the elevator system. On the basis of the identification data the elevator system can determine the destination floor specific to a passenger, the so-called home floor, and allocate from the elevator system an elevator car for taking the passenger from the call-giving floor/departure floor to the destination floor in question. The destination floor is typically the floor to which a passenger repeatedly travels, e.g. the floor on which his/her work point is situated. Often access control is also connected to the aforementioned prior-art call-giving solutions in such a way that for each passenger information about those floors to which the passenger has an access right is recorded in the elevator system or in a special access control system.

A number of drawbacks are, however, connected to the prior-art call-giving solutions described above. When the elevator system has allocated an elevator car serving the passenger, the passenger must one way or another be guided to the elevator car in question. If the passenger forgets the guidance information or does not notice it, he/she can end up in the wrong elevator car, which will not after all stop at his/her home floor. If the guidance information is transmitted to a terminal device of the passenger, instead of as public signals, the passenger must get his/her terminal device out, which hinders and slows down the arrival of the passenger at his/her destination. In solutions according to prior art it is often necessary to install base stations, including base stations for wireless communication, in different parts of the building, making the solution complex and expensive.

AIM OF THE INVENTION

The aim of the present invention is to eliminate or at least to alleviate the drawbacks presented above that occur in prior-art solutions. The aim of the invention is also to achieve one or more of the following objectives:

- to offer a user-friendly, fully-automatic call-giving solution in elevator systems,
- to reduce the risk of a passenger getting lost in large buildings,
- a self-learning elevator system, which automatically identifies the home floor of a passenger and/or other travel habits of the passenger relating to use of the elevator system, and
- to facilitate and speed up travel in elevator systems.

SUMMARY OF THE INVENTION

Example embodiments of the invention are characterized by what is disclosed in the claims. Some inventive embodiments are also presented in the descriptive section and in the drawings of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. The features of the various embodiments can be applied within the framework of the basic inventive concept in conjunction with other embodiments.

The basic concept of the invention is that the acceleration of a passenger is measured and the acceleration data is compared with the acceleration data of each elevator car leaving a floor. When there is sufficient correlation between the aforementioned acceleration data (passenger/elevator car), the elevator car into which the passenger has gone can be deduced and the elevator car can be automatically guided to the destination floor desired by the passenger.

The invention discloses a method for serving passenger-specific destination calls in an elevator system, which comprises at least one elevator and also means for determining the acceleration data of an elevator car of the aforementioned elevator. In the method a passenger-specific destination call is registered, which destination call comprises at least information about the destination floor of a passenger. The vertical acceleration of a passenger is measured with a terminal device in the possession of the passenger. The acceleration data of each elevator car leaving a floor is compared with the acceleration data of the passenger. If there is sufficient correlation between the acceleration data of the passenger and the acceleration data of the aforementioned elevator car, the elevator car in question is guided to the destination floor according to the destination call.

A passenger-specific destination call means in this context a call that comprises at least information about the destination floor of a passenger as well as identification data of the passenger, e.g. an individual ID code. A passenger can give a destination call manually, e.g. with his/her terminal device, e.g. from a mobile phone, or the control system can generate it automatically on the basis of the ID code of the passenger/terminal device.

The terminal device of a passenger comprises measuring means for measuring the acceleration of the passenger, more particularly for measuring the vertical acceleration component. The acceleration data of the elevator cars can be determined e.g. in the control system of the elevator system. For comparing the acceleration data, they are wirelessly transmitted from a terminal device to the control system of the elevator system and/or vice versa.

In one embodiment of the invention information about the departure floor of the passenger, in addition to the destination floor data, is connected to the aforementioned destination call, and at least one elevator car is allocated to collect the passenger from the departure floor according to the aforementioned destination call.

In one embodiment of the invention the simultaneous departure of two or more elevator cars in the same drive direction inside a given time window is prevented. The prevention can apply to the elevator cars leaving from the same floor, e.g. from the departure floor of the passenger, or to all elevator cars leaving from any floor whatsoever. As a result of the embodiment, it is possible to reliably determine in which elevator car a passenger presumably is.

In one embodiment of the invention different acceleration profiles are used for different elevator cars. The acceleration profile determined on the basis of the acceleration data of a passenger is compared with the aforementioned known acceleration profiles for determining the correlation between the acceleration data. An acceleration profile refers in this context to the determined/measured acceleration data from the desired time interval. As a result of the embodiment, it is possible to reliably and quickly determine in which elevator car a passenger presumably is.

In one embodiment of the invention the departure of an elevator car allocated to the passenger from the departure floor of the passenger is delayed if the elevator car is empty. As a result of the embodiment, a passenger has more time after registration of a destination call to get into the elevator car serving him/her.

In one embodiment of the invention one or more new elevator cars are allocated to a passenger if the passenger, on the basis of the comparison of acceleration data, has not transferred into the elevator car already allocated to him/her on the departure floor. As a result of the embodiment, a passenger receives faster elevator service even though he/she did not make it into the elevator car already allocated to him/her.

In one embodiment of the invention the destination call of a passenger is removed from the plurality of calls to be served if he/she, on the basis of the comparison of the acceleration data, has not transferred into any elevator car at all inside the given time window after the moment the destination call is registered.

In one embodiment of the invention on the basis of the comparison of the acceleration data the exit floor of a passenger from the elevator car is identified, and one or more monitoring procedures are performed if the exit floor is different to the destination floor according to the destination call of the passenger. As a result of the embodiment access control and passenger guidance in an elevator system can be improved.

In one embodiment of the invention statistical data about the elevator journeys made by a passenger is collected and at least the home floor of a passenger is determined on the basis of the aforementioned statistical data.

The present invention also presents an elevator system. The elevator system comprises one or more elevators with elevator cars, a control system of the elevator system, and means for registering passenger-specific destination calls. According to the invention the elevator system comprises means for determining the acceleration data of an elevator car, a terminal device for measuring the vertical acceleration of a passenger, in connection with the control system a base station for wirelessly transmitting the acceleration data between the control system and the terminal device, comparison means for comparing the acceleration data of a passenger and the acceleration data of the elevator cars. The control system is arranged to guide an elevator car to the destination floor according to a destination call if, on the basis of the result produced by the comparison means, there is sufficient correlation between the acceleration data of the elevator car and the acceleration data of the passenger.

In one embodiment of the invention the terminal device is a mobile phone.

In one embodiment of the invention the terminal device wirelessly sends a passenger-specific ID code to the control system of the elevator system.

In one embodiment of the invention in connection with the control system is a reader device, which reads a passenger-specific ID code from an identifier in the possession of a passenger. The identifier is e.g. an access card comprising RFID, a barcode or a magnetic stripe.

Wireless communication between a terminal device and the control system occurs e.g. via the base station of a mobile phone network and/or via a Bluetooth base station and/or via a WLAN base station and/or via a DASH7 base station.

In one embodiment of the invention the means for comparing acceleration data is in connection with the control system of the elevator system. The terminal device transmits the acceleration data of a passenger to the comparison means of the control system. In the embodiment only the acceleration data of a passenger is transmitted from a terminal device to the control system of the elevator system, in which case the data transfer requirement is minimized.

In one embodiment of the invention the comparison means are integrated into connection with a terminal device. The control system determines the acceleration data of the elevator cars and transmits them to the terminal device. The terminal device compares the acceleration data of a passenger and the acceleration data of the elevator cars for determining the correlation of the acceleration data. In this embodiment the control system sends the acceleration data of the elevator cars to a terminal device in the possession of a passenger, which terminal device performs a comparison of the acceleration data and sends the result of the comparison to the control system. The acceleration data of each elevator car is recorded in the control system. The control system can send in advance at least some of the acceleration data of the elevator cars to the terminal device before the elevator cars leave from a floor. As a result of the embodiment, the speed of the data transfer connection can be reduced because the data to be transmitted between the control system and a terminal device does not need to be in real-time and the control system can send the same data simultaneously to a number of terminal devices.

With the solution according to the invention numerous advantages are achieved compared to prior-art solutions. In the elevator system according to the invention a passenger can go into any elevator car whatsoever that is on the departure floor and that has a drive direction towards his/her desired destination floor. As a result of the invention passengers do not need to be guided to a certain elevator car, which makes travel easier and reduces the risk of getting lost. New elevator cars can be allocated to a passenger if he/she did not manage to get into the elevator car already allocated to him within the assumed time. By registering a passenger-specific destination call automatically, e.g. on the basis of an ID code received from a terminal device in the pocket of a passenger, a passenger can go into an elevator car on the departure floor without taking out his/her terminal device at any stage of his/her elevator trip. The elevator system according to the invention is also self-learning, wherein e.g. the home floor of a passenger is determined automatically on the basis of the elevator trips made by the passenger.

As a result of the invention travel is substantially facilitated and speeded up compared to solutions known in the art. Other advantages of the invention are also presented above in connection with the different embodiments.

LIST OF FIGURES

Figure 2:
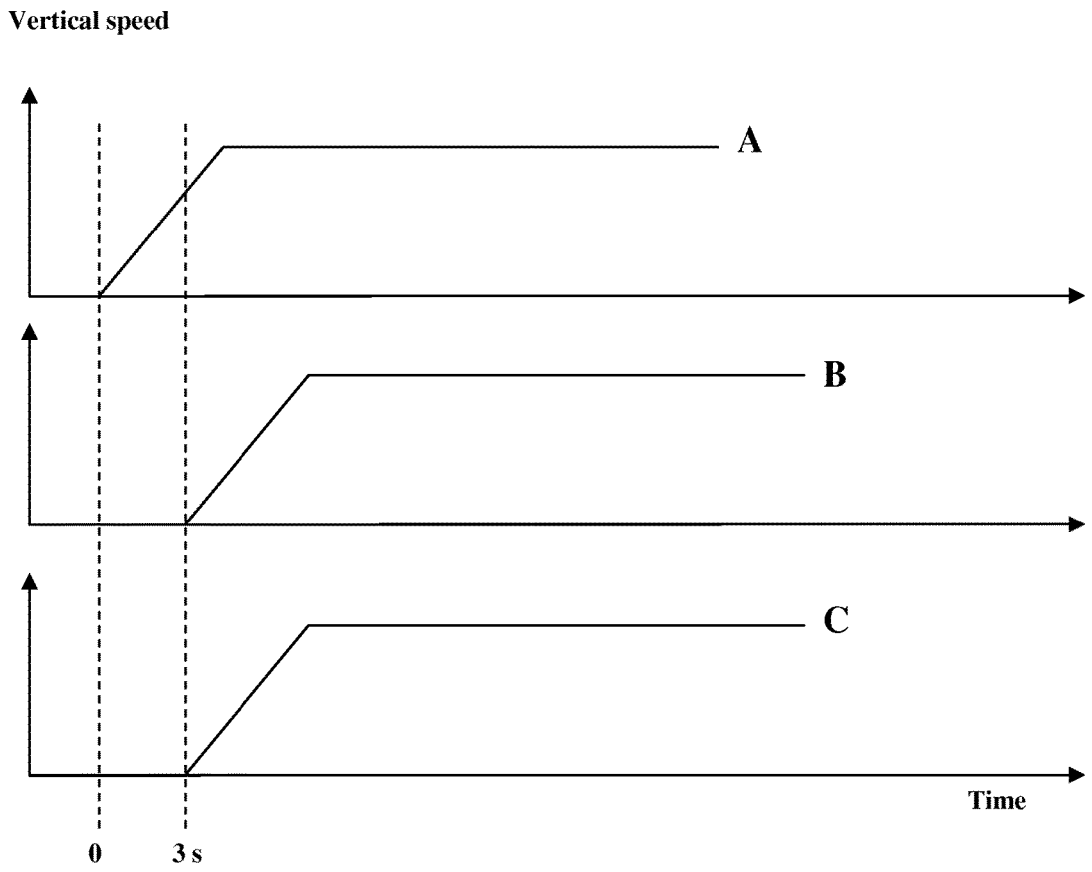
Figure 3:
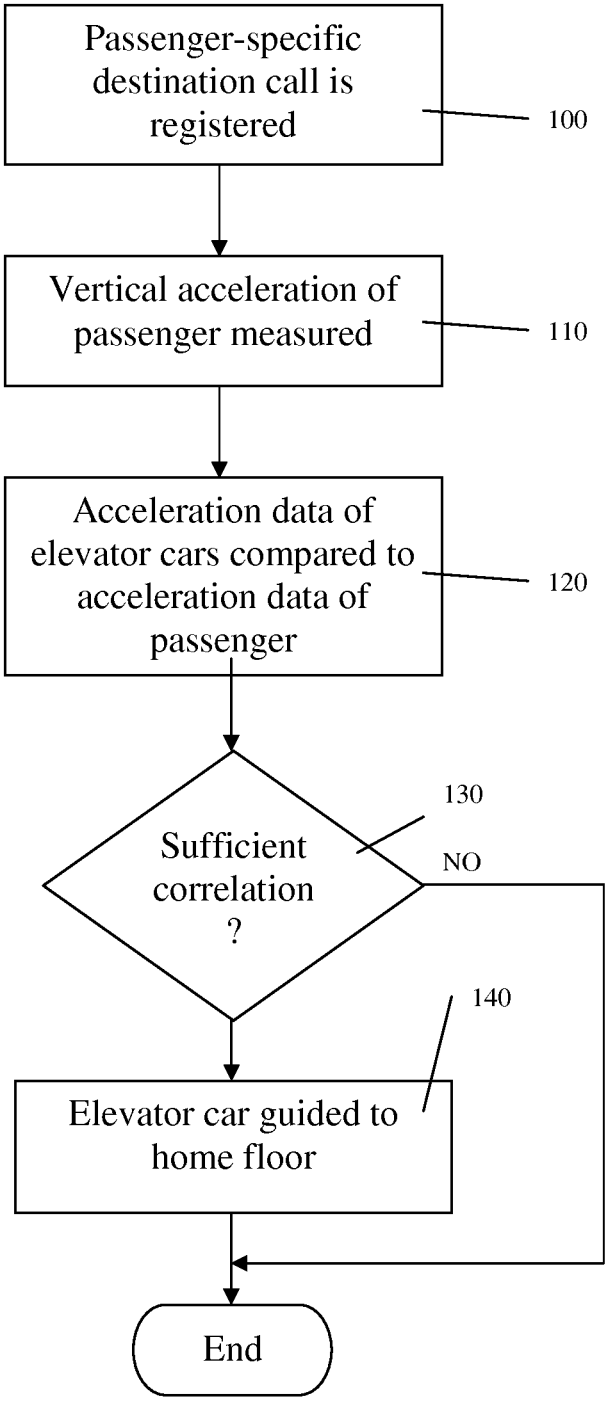

In the following, the invention will be described in detail by the aid of a few examples of its embodiments, wherein:

FIG. 1 presents an elevator system according to the invention,

FIG. 2 presents by way of example the vertical speed profiles of elevator cars and of a passenger, and FIG. 3 presents a flowchart of the method according to the present invention.

DETAILED DESCRIPTION OF THE INVENTION

FIG. 1 presents one elevator system 10 according to the invention, which comprises two elevators with elevator cars 10*a* and 10*b* as well as a control system 10*c* controlling the elevators. In the possession of a passenger is a terminal device 20, integrated into which are measuring means 20*c* for measuring the vertical acceleration of the passenger. The terminal device 20 communicates wirelessly with the control system 10*c* via the base station 14. The base station is e.g. a base station belonging to a mobile phone network or a base station of some other wireless data transfer network suited to the purpose. Marked in FIG. 1 with the reference number 15 is a back-end system (comparison means), which receives the acceleration data of the elevator cars and of a passenger and compares them with each other. In FIG. 1 the back-end system 15 has been integrated into the control system 10*c*, but some or all of its functions can be integrated into a terminal device 20 and/or implemented as dedicated apparatus.

The elevator system 10 can be provided with conventional call-giving buttons, such as with up/down buttons and/or destination call buttons in the elevator lobbies and/or floor buttons (not presented in FIG. 1) in the elevator cars. Signs, e.g. direction arrows, are installed in connection with the door openings of the elevators, which signs indicate the direction of travel, i.e. up or down (not presented in FIG. 1), of each elevator car. On the basis of the guidance of the direction arrows, a passenger is able to go into an elevator car that is going in the direction in which his/her home floor is situated.

When the passenger arrives in the entrance lobby F1, the terminal device sends via the base station 14 the individual ID code of the passenger/terminal device to the control system 10*c*. The sending starts e.g. on the basis of GPS coordinates data determined by the terminal device when the passenger arrives in the building. The home floor of each passenger is recorded in the memory 10*d* of the control system 10*c*. The control system 10*c* determines on the basis of the aforementioned ID code the home floor of the passenger and registers a destination call corresponding to it. The passenger can also be identified from an access card 42, which the passenger takes to an identifier reading device 41. The reading device reads the passenger-specific ID code contained in the identifier 42 and transmits it to the control system 10*c*, which registers a passenger-specific destination call in the manner described above. The identifier can be integrated into a terminal device or it can be an identifier separate to the terminal device. The identifier can be e.g. an NFC identifier, an RFID identifier, a barcode identifier, a magnetic card or corresponding.

Also information about the departure floor of the passenger, i.e. the floor on which the passenger is at the time the call is registered, can be connected to the aforementioned destination call. The departure floor is determined e.g. on the basis of a previous elevator journey made by the passenger and/or on the basis of the time of day, e.g. in the mornings the departure floor is assumed to be the entrance lobby floor F1 and in the evenings it is assumed to be the home floor of the passenger. A passenger can also manually give with his/her terminal device both a departure floor and a destination floor. The departure floor can also be assumed to be constant, e.g. always to be the entrance lobby floor F1. For the identification of the departure floor, beacons that send floor information and/or other position information can be installed on floors, the position information sent by which beacons being received by a terminal device 20 automatically.

When the home floor and the departure floor of a passenger have been determined, the control system 15 allocates for the use of the passenger at least one elevator car e.g. on the basis of the following rules:

a) elevator cars that are traveling in the direction of the home floor of the passenger and for which a stop at the home floor of the passenger has already been registered for letting passengers out of the elevator car and/or for taking passengers into the elevator car, and in which there is still room for one new passenger, are allocated for the use of the passenger.

b) elevator cars that have stopped at the departure floor of the passenger and that are empty are allocated for the use of the passenger. The doors of allocated elevator cars are opened for letting the passenger into the elevator car and the drive direction of the elevator car to the predicted destination floor can be indicated on the departure floor with the aforementioned direction arrows.

c) an elevator car that is standing empty at another floor than the departure floor of the passenger is allocated for the use of the passenger and a call is registered for the elevator for driving the elevator car to the departure floor of the passenger. If there are simultaneously in the elevator system a number of elevator cars fulfilling the aforementioned criteria, some elevator car can be selected from them on the basis of the desired optimization criterion, e.g. the elevator car that is closest to the departure floor of the passenger. The drive direction of an elevator car to the predicted destination floor can be indicated with direction arrows on the departure floor.

If the departure floor of the passenger is not known, the passenger can call an elevator car to his/her departure floor e.g. with the up/down call pushbuttons.

When each of the elevator cars (allocated to a passenger or an unallocated elevator car) stops at the departure floor of the passenger and a passenger transfers into it, the base station 14 receives from the terminal device 20 of the passenger in the elevator car the acceleration data of the passenger and transfers them to the back-end system 15 of the control system. The control system 10*c* determines and also transfers to the back-end system 15 the acceleration data of each elevator car, said data comprising at least information about the floor from which the elevator car has started moving or at which floor the elevator car is stopping/ has stopped. The back-end system 15 determines on the basis of the acceleration data the vertical acceleration profile of the passenger and also the acceleration profile of each elevator car that has left a floor. The back-end system compares the acceleration profiles of the passenger and of the elevator cars with each other. If there is sufficient correlation between them, the control system identifies in which elevator car the passenger is. The control system 10*c* gives to the elevator car in question for serving a destination call registered to the passenger for taking the passenger to his/her destination floor. At the same time the control system removes the other allocations made for the passenger from the elevator cars.

For determining sufficient correlation of the acceleration data, the back-end system calculates e.g. the quadratic difference over the desired time interval, e.g. for a duration of 2 seconds, between the vertical acceleration of the passenger and the acceleration/speed of each elevator car that has left a floor from the collected measurement results for acceleration/speed from the moment the elevator car left onwards. If the root sum square of the differences is below a given threshold value, the back-end system deduces that the passenger is in the elevator car in question.

So that a number of elevator cars do not simultaneously leave from floors in the same drive direction (up/down), the control system 10*c* delays the departures of the elevator cars relative to each other. A delay, e.g. a delay of at least 1 s, is arranged between the consecutive departures of the different elevator cars. The delay prevents the acceleration data of the elevator cars being "confused" with each other. The delay between simultaneous departures can apply to all elevator cars leaving from the same floor or to all elevator cars leaving from any floor whatsoever. FIG. 2 presents by way of example graphs of the vertical speed of elevator cars and of a passenger over a certain time span. In FIG. 2 the elevator car 10*a* leaves a floor at the time 0 going upwards (graph A), the elevator car 10*b* at the time 3 s going upwards (graph B), and the vertical speed (graph C) of a passenger measured by means of a terminal device. By comparing the graphs of FIG. 2 with each other it can be deduced that there is sufficient correlation between the speed profiles of the elevator car 10*b* and of the passenger, and that the passenger is therefore in the elevator car 10*b*.

Since the acceleration profiles/speed profiles of the elevator cars are generally constant and the same as each other, the constant profile in question can be recorded in advance in the memory 15*a* that is in connection with the back-end system, and it is possible to read it from there when information about the moment of departure and departure floor of some elevator car is known. If the acceleration profiles/speed profiles are different for different elevator cars, the profile shapes can be utilized in the comparison of acceleration data. In this embodiment the shape of the acceleration profile/speed profile of which elevator car best resembles the measured acceleration profile/speed profile of the passenger is identified. The acceleration profiles/speed profiles of all the elevator cars are recorded in the memory 15*a* separately.

If an elevator car allocated to a passenger has stopped at the departure floor of the passenger but calls given by other passengers are also allocated to it, it is possible that the elevator car leaves the departure floor before the passenger has had time to get into it. For minimizing the problem, the control system 10*c* can delay the departure of the elevator car for the duration of the given maximum delay or until the control system 10*c* detects, e.g. using the door photocell and/or load weighing device, that all the passengers to be served have arrived in the elevator car.

If one or more elevator cars allocated to a passenger leave from the departure floor of the passenger but on the basis of the comparison of the acceleration data the passenger has not transferred into any of them, the control system 10*c* can allocate new elevator cars for serving the passenger. For example, if an elevator car that has not yet been allocated to a passenger becomes empty, the control system can allocate it for the use of the passenger and automatically send it the departure floor of the passenger. The allocation of new elevator cars shortens the waiting time of a passenger and therefore also improves the service received by the passenger. On the other hand, if the elevator system does not detect a passenger within the maximum time, e.g. within five minutes from when the destination call of the passenger was registered, the control system 10*c* removes the destination call of the passenger from the plurality of calls to be served.

According to one embodiment of the invention the floor on which the passenger has exited from the elevator car is identified on the basis of the acceleration data. The identification occurs e.g. as follows: an elevator car, in which it has been verified there is a passenger, stops at a floor and continues after that to some other floor; if the comparison of the acceleration data in the manner described above indicates that a passenger is no longer in the elevator car in question, the control system 10*c* compares the destination floor of a destination call registered to a passenger with the floor on which a passenger exited the elevator car; if on the basis of the comparison of the floors the exit floor is not a destination floor of a passenger (home floor), the control system 10*c* performs one or more monitoring procedures, e.g. sending a notification to the terminal device 20 of the passenger and/or to the tracking center 40 of the access control system about the incorrect exit floor.

The collection of statistical data about the elevator journeys made by a passenger is also presented as an inventive concept in the elevator system according to the invention. The elevator system is provided with conventional call buttons (up/down buttons in the elevator lobbies, floor buttons in the elevator cars), with which a passenger gives elevator calls. The departure floors and/or destination floors of elevator journeys made by a passenger are identified on the basis of the acceleration data in the manner described above. When sufficient statistical data has been collected about the elevator journeys made by the passenger, it is possible on the basis of said data to determine a passenger-specific departure floor and/or home floor and record it/them in a passenger-specific manner in the memory 10*d*. When the passenger arrives in the building after this and he/she is identified on the basis of the ID code sent by the terminal device 20 or contained in the identifier 42, the control system 10*c* automatically registers a passenger-specific destination call to the floor automatically determined in this manner.

In the embodiments described above, the base station 14 is assumed to be a base station of a mobile phone network, in which case the terminal device 20 can be a mobile phone provided with means 20*c* measuring acceleration, with a keyboard 20*a* and with a display 20*b*. The solution according to the invention can also be implemented with preferably a terminal device comprising only means 20*c* for measuring acceleration as well as communication means e.g. according to the DASH7 standard. A base station 14 according to the DASH7 standard can be disposed e.g. in the machine room of the elevator system 10, where it can receive from a terminal device the acceleration data of a passenger and an ID code identifying the passenger from any floor whatsoever served by the elevator system.

In the solution according to the invention the base stations of a wireless local area network WLAN and/or Bluetooth base stations that are in the building can be utilized for communication. The aforementioned base stations are capable of local communication and therefore enable the automatic identification of the departure floor of a passenger on the basis of the location of the base stations. The base stations in question can be disposed in floor lobbies and/or in elevator cars.

As presented above, in the elevator system according to the invention the elevator service of a passenger can be fully automatic in such a way that the passenger does not need to take out his/her terminal device at any stage of his/her elevator journey, but instead it can be e.g. in the handbag or pocket of the passenger. This facilitates and accelerates travel, particularly if the same elevator journey is made repeatedly.

In FIG. 1 the back-end system 15 has been presented as a part of the control system 10*c*, but some or all of its functions can be integrated into a terminal device 20. If the back-end system 15 is integrated into a terminal device 20, the terminal device 20 receives via a base station 14 the acceleration data of the elevator cars that the control system sends. The terminal device 20 compares the acceleration data of passenger measured by it with the acceleration data of the elevator cars. If the terminal device 20 detects that there is sufficient correlation between the aforementioned acceleration data, it sends via the base station 14 to the control system 10*c* information about which elevator car the passenger is in on the basis of the comparison. By integrating a back-end system 15 (comparison means) into terminal devices, the need for data transfer between terminal devices and the control system can be reduced because the control system can send the same acceleration data concerning elevator cars simultaneously to a number of terminal devices. The computing load of the control system also decreases because the calculation for comparing acceleration data is distributed to a number of terminal devices. The embodiment therefore enables elevator systems in which the number of simultaneous passengers can be very high indeed.

FIG. 3 presents as a flowchart the method according to the invention. In phase 100 a passenger-specific destination call is registered, in phase 110 the vertical acceleration of the passenger is measured, in phase 120 the acceleration data of the elevator cars leaving floors is compared with the measured acceleration data of a passenger, and in phase 130 it is deduced whether there is sufficient correlation between the acceleration data of the passenger and the acceleration data of some elevator car. If there is sufficient correlation, phase 140 is executed; otherwise no phase is executed. In phase 140 the elevator car identified on the basis of the comparison of acceleration data is guided to the destination call according to the destination call of the passenger.

The invention is not only limited to be applied to the embodiments described above, but instead many variations are possible within the scope of the inventive concept defined by the claims below. It is obvious to the person skilled in the art that, inter alia, acceleration data can be converted into speed data and vice versa, and instead of the measuring/comparison of acceleration data the speed data can be measured/compared with each other. The control system of the elevator system can comprise one or many control units, which control(s) an individual elevator or elevator group. The terminal device can also measure the horizontal acceleration components, in addition to the vertical acceleration component, of a passenger and address them all in the comparison of acceleration data by taking into account that the horizontal acceleration components of the elevator cars is close to zero.

The invention claimed is:

1. A method of operating an elevator controller, the method comprising:

registering a passenger-specific destination call, the passenger-specific destination call including destination information indicating a destination floor of a passenger;

receiving passenger acceleration data indicating a vertical acceleration of the passenger in one of a plurality of elevator cars;

comparing elevator acceleration data of the plurality of elevator cars departing a floor with the passenger acceleration data of the passenger;

determining whether a correlation exists between the passenger acceleration data and the elevator acceleration data of a detected one of the plurality of elevator cars; and guiding the detected one of the plurality of elevator cars that has left a floor to the destination floor according to the passenger-specific destination call, if the determining determines that the correlation exists.

2. The method according to claim 1, further comprising:

linking information indicating a departure floor of the passenger with the destination information; and allocating at least one of the plurality of elevator cars as an allocated elevator car to collect the passenger from the departure floor according to the destination information.

3. The method according to claim 1, further comprising:

controlling the plurality of elevators such that, within a time window, two or more of the plurality of elevator cars are prevented from being driven in the same direction.

4. The method according to claim 1, further comprising:

assigning unique acceleration profiles to each of the plurality of elevator cars, and wherein the comparing compares the passenger acceleration data with the acceleration profiles.

5. The method according to claim 2, further comprising:

delaying a departure of the allocated elevator car from the departure floor, if the allocated elevator car is empty.

6. The method according to claim 2, further comprising:

allocating a new one of the plurality of elevator cars to the passenger, if the determining determines that the correlation does not exist.

7. The method according to claim 1, further comprising:

deregistering the passenger-specific destination call if based on the comparison, the passenger has not transferred into any of the plurality of elevator cars within a time window after the registering registers the passenger-specific destination call.

8. The method according to claim 1, further comprising:

identifying an exit floor of the passenger based on the comparison; and performing one or more monitoring procedures, if the exit floor is different than the destination floor included in the destination information.

9. The method according to claim 1, further comprising:

collecting statistical data about elevator journeys made by the passenger; and determining a home floor associated with the passenger based on the statistical data, the home floor being a most frequent destination floor of the passenger.

10. An elevator system comprising:

a plurality of elevator cars; and an elevator controller including a processor configured to, register a passenger-specific destination call, the passenger-specific destination call including destination information indicating a destination floor of a passenger, receive passenger acceleration data indicating a vertical acceleration of the passenger in one of the plurality of elevator cars, compare elevator acceleration data of the plurality of elevator cars departing a floor with the passenger acceleration data, determine whether a correlation exists between the passenger acceleration data and the elevator acceleration data of a detected one of the plurality of elevator cars, and guide the detected one of the plurality of elevator cars that has left a floor to the destination floor according to the passenger-specific destination call, if the determining determines that the correlation exists.

11. The elevator system according to claim 10, wherein the elevator controller is configured to receive the measurement data from a terminal device associated with the passenger.

12. The elevator system according to claim 10, wherein the elevator controller is configured to receive the passenger-specific destination call via a reader device configured to read identification data contained in an identifier associated with the passenger.

13. The elevator system according to claim 10, further comprising:

a base station configured to wirelessly transmit the passenger acceleration data to the elevator controller, the base station being one of a base station of a mobile phone network; a DASH7 base station; a Bluetooth base station; a WLAN base station.

14. The elevator system according to claim 10, wherein the elevator controller is further configured to, assign unique acceleration profiles to each of the plurality of elevator cars, and compare the passenger acceleration data with the acceleration profiles.

15. An elevator controller comprising:

a memory configured to store acceleration data therein; and a processor configured to, register a passenger-specific destination call, the passenger-specific destination call including destination information indicating a destination floor of a passenger, receive passenger acceleration data indicating a vertical acceleration of the passenger in one of a plurality of elevator cars, compare elevator acceleration data of the plurality of elevator cars departing a floor with the passenger acceleration data, determine whether a correlation exists between the passenger acceleration data and the elevator acceleration data of a detected one of the plurality of elevator cars, and guide the detected one of the plurality of elevator cars that has left a floor to the destination floor according to the passenger-specific destination call, if the processor determines that the correlation exists.

16. The elevator controller according to claim 15, wherein the processor is configured to receive the measurement data from a terminal device associated with the passenger.

17. The elevator controller according to claim 15, wherein the processor is configured to, assign unique acceleration profiles to each of the plurality of elevator cars, and compare the passenger acceleration data with the acceleration profiles.

* * * * *